US007946092B2

(12) United States Patent
Veerman et al.

(10) Patent No.: US 7,946,092 B2
(45) Date of Patent: May 24, 2011

(54) METHOD OF CONSTRUCTING A BUILDING, SUCH BUILDING, AND WALL AND FLOOR ELEMENTS FOR USE THEREIN

(75) Inventors: Albertus Theodorus Gerardus Veerman, Volendam (NL); Aije Jacob Simons, Volendam (NL); Bernardus Johannes Bos, Lutjewinkel (NL)

(73) Assignee: Veerhuis Beheer, B.V., Lutjewinkel (NL)

( * ) Notice: Subject to any disclaimer, the term of this patent is extended or adjusted under 35 U.S.C. 154(b) by 0 days.

(21) Appl. No.: 12/605,928

(22) Filed: Oct. 26, 2009

(65) Prior Publication Data

US 2010/0088986 A1 Apr. 15, 2010

Related U.S. Application Data

(63) Continuation of application No. 11/262,474, filed on Oct. 28, 2005, now abandoned.

(60) Provisional application No. 60/730,549, filed on Oct. 26, 2005.

(51) Int. Cl.
*E04C 2/00* (2006.01)
*E04B 1/74* (2006.01)

(52) U.S. Cl. ..... 52/741.1; 52/481.1; 52/309.9; 52/406.2; 52/279; 52/468

(58) Field of Classification Search ..... 52/236.3, 52/309.9, 288.1, 236.6, 236.9, 432, 434, 52/481.1, 479, 407.3, 481.2, 406.2, 574, 52/280, 287.1, 275, 272, 279, 276, 281, 468, 52/741.1

See application file for complete search history.

(56) References Cited

U.S. PATENT DOCUMENTS 595,391 A * 12/1897 Johnson ..... 52/234

(Continued)

FOREIGN PATENT DOCUMENTS

EP O727535 A 9/1995

(Continued)

OTHER PUBLICATIONS

European Search Report from the European Patent Office in counterpart foreign application No. 04105914.8 filed Nov. 19, 2004.

(Continued)

*Primary Examiner* — Robert J Canfield
*Assistant Examiner* — Brent W Herring
(74) *Attorney, Agent, or Firm* — Steven M. Koehler; Westman, Champlin & Kelly, P.A.

(57) ABSTRACT

The invention relates to a method of constructing a building, comprising the step of providing a skeleton for a building wall of the building. The skeleton includes at least upright building elements such as columns or dividing walls. At least one lightweight, heat insulating and fire retarding wall element is placed between each adjacent pair of said columns. The columns are covered to provide substantially closed wall surfaces. The wall surfaces are covered with a covering layer having properties so as to provide fire-resistance to the complete wall. The covering layer on the inside wall surface may include a base layer of modified resin mortar, and a top layer of plaster mortar. The covering layer on the outside wall surface may include a base layer of modified resin mortar and a top layer of mineral mortar. Lightweight, heat insulating floor elements are placed and interconnected, and supported if necessary, and thereafter structural fill-material, such as concrete, is poured onto the floor elements to form a floor. The invention also includes a building, and wall and floor elements.

31 Claims, 10 Drawing Sheets

U.S. PATENT DOCUMENTS

| | | | |
|---|---|---|---|
| 1,474,148 | A | 11/1923 | Hopkins |
| 1,619,737 | A | 3/1927 | Krummel |
| 1,757,763 | A | 5/1930 | Betzler |
| 1,890,432 | A | 12/1932 | Billner |
| 1,963,410 | A | 6/1934 | Kartowicz |
| 1,975,613 | A | 10/1934 | Nystrom et al. |
| 2,116,946 | A | 5/1938 | Huntington |
| 2,142,523 | A | 1/1939 | McLaughlin, Jr. |
| 2,151,244 | A | 3/1939 | Stites |
| 2,156,347 | A | 5/1939 | McLaughlin, Jr. |
| 2,208,589 | A | 7/1940 | Leemhuis |
| 2,249,027 | A | 7/1941 | Mulderink |
| 2,313,839 | A | 3/1943 | Olsen |
| 2,317,634 | A | 4/1943 | Olsen |
| 2,362,162 | A | 11/1944 | Sheldon |
| 2,818,824 | A | 1/1958 | Read et al. |
| 3,207,619 | A | 9/1965 | Klimboff |
| 3,305,993 | A | 2/1967 | Nelsson |
| 3,410,044 | A | 11/1968 | Moog |
| 3,435,581 | A | 4/1969 | Ahlqvist |
| 3,462,339 | A | 8/1969 | Poms |
| 3,531,901 | A | 10/1970 | Will, Jr. et al. |
| 3,562,985 | A | 2/1971 | Nicosia |
| 3,765,138 | A | 10/1973 | Bentle |
| 3,782,049 | A | 1/1974 | Sachs |
| 3,803,788 | A | 4/1974 | Artmann |
| 3,921,355 | A | 11/1975 | Pennecot |
| 3,965,635 | A | 6/1976 | Renker |
| 3,978,018 | A | 8/1976 | Self |
| 4,193,240 | A | 3/1980 | Odoerfer |
| 4,348,841 | A | 9/1982 | Ueno et al. |
| 4,486,993 | A | 12/1984 | Graham et al. |
| 4,638,606 | A | 1/1987 | Wendt |
| 4,641,468 | A | 2/1987 | Slater |
| 4,674,250 | A | 6/1987 | Altizer |
| 4,689,930 | A | 9/1987 | Menchetti |
| 4,823,534 | A | 4/1989 | Hebinck |
| 4,964,252 | A | 10/1990 | Guliker |
| 5,353,562 | A | 10/1994 | Decker |
| 5,417,023 | A | 5/1995 | Mandish |
| 5,617,686 | A | 4/1997 | Gallagher, Jr. |
| 5,728,428 | A | 3/1998 | Rusinoff |
| 5,749,187 | A | 5/1998 | Umehara et al. |
| 5,765,333 | A | 6/1998 | Cunningham |
| 6,061,985 | A | 5/2000 | Kraus et al. |
| 6,112,473 | A | 9/2000 | Pingel |
| 6,279,284 | B1 | 8/2001 | Moras |
| 6,298,622 | B1 | 10/2001 | Cretti |
| 6,311,442 | B1 | 11/2001 | Watanabe |
| 6,349,509 | B1 | 2/2002 | Pingel |
| 6,438,914 | B1 | 8/2002 | Robertson |
| 6,553,731 | B2 | 4/2003 | Hsueh |
| 6,799,404 | B2 | 10/2004 | Spransy |
| 7,100,342 | B2 | 9/2006 | Holloway |
| 2001/0002529 | A1 | 6/2001 | Commins et al. |
| 2003/0041544 | A1 | 3/2003 | Rusek, Jr. et al. |
| 2004/0103610 | A1 | 6/2004 | Axsom |
| 2004/0148889 | A1 | 8/2004 | Bibee et al. |

FOREIGN PATENT DOCUMENTS

| | | |
|---|---|---|
| EP | A1180564 | 2/2002 |
| FR | 2359942 A | 3/1978 |
| JP | 09088091 | 3/1997 |
| JP | 2000281414 | 3/1999 |

OTHER PUBLICATIONS

Brian D. Erickson, *EIFS* v. *Stucco*: What's the Difference?, The Investigative Engineer, Aug. 2004, A Publication of Professional Investigative Engineers.

* cited by examiner

METHOD OF CONSTRUCTING A BUILDING, SUCH BUILDING, AND WALL AND FLOOR ELEMENTS FOR USE THEREIN

CROSS-REFERENCE TO RELATED APPLICATION

The present application is a continuation of and claims priority of U.S. patent application Ser. No. 11/262,474, filed Oct. 28, 2005, which is based on and claims the benefit of U.S. provisional patent application Ser. No. 60/730,549, filed Oct. 26, 2005, the contents of both of which are hereby incorporated by reference in their entirety.

BACKGROUND OF THE INVENTION

The invention relates to a method of constructing a building, a building preferably constructed according to this method and wall and floor elements for use therein.

In the prior art, several building methods are known in which lightweight wall elements are used. In most cases, the wall elements are made of expanded polystyrene. Examples of these methods and the resulting buildings are disclosed in U.S. Pat. No. 5,353,562, U.S. Pat. No. 4,823,534 and U.S. Pat. No. 5,617,686.

SUMMARY OF THE INVENTION

An aspect of the present invention is to provide an improved method of constructing a building. The method of constructing a building can include the following steps in a suitable order: providing a skeleton for the building, said skeleton including at least upright building elements, such as columns or dividing walls, placing at least one, lightweight, heat insulating and fire retarding wall element between each adjacent pair of said upright building elements, covering said upright building elements at least on the outside to provide at least a substantially closed outer wall surface, and covering the inner and outer wall surfaces with a covering layer having properties so as to provide at least fire-resistance to the complete wall.

As used herein "fire retardant" or "fire resistance" (and variants thereof) is the ability of a material or component to inhibit, slow down or stop the spreading of fire. In the context of the environment of the invention, materials or construction components/techniques are used or selected with the intention of at least slowing down the spreading of fire in the building component or assembly (e.g. wall panel) than what would otherwise exist if the material or construction component/technique was not used or selected. Although there exist many standards and measuring techniques for measuring the material's or construction component's fire retardation rating, without limitation one measure is rated in minutes, where a longer time signifies a greater degree of fire retardation. In one exemplary embodiment, a 90 minute rating for a completed wall component is obtained for the completed wall component comprising: an EPS (expanded polystyrene) core approximately 150 mm thick with a thin finish coat on each side to finish the EPS surfaces; an interior coating having an approximately 7 mm adhesive/priming mortar layer with a glass fibre (coarse mesh, e.g. 6×6 mm mesh) in it, a glass fibre (fine mesh) and gypsum plaster approximately 10 mm thick; and an outer coating having an approximately 7 mm adhesive/priming mortar layer with a glass fibre (coarse mesh, e.g. 6×6 mm mesh) in it and cementious plaster approximately 15 mm thick. Nevertheless, lower ratings can also be considered fire retardant depending upon applicable building codes. If necessary, "fire retardant" can be considered at least greater than 30 minutes.

As used herein "insulated" (thermal resistance) is the ability of a material or component to inhibit the transfer of heat. In the context of the environment of the invention, materials or construction components/techniques are used or selected with the intention of inhibiting the transfer of heat in the building component or assembly (e.g. wall panel) than what would otherwise exist if the material or construction component/technique was not used or selected. Although there exist many standards and measuring techniques for measuring the material's or construction component's insulation rating, without limitation one measure is rated in "$m^2K^O$/Watt", where a greater value signifies a greater degree of thermal resistance. In the specific exemplary embodiment described above, an insulating rating of approximately 8 $m^2K^O$/Watt was obtained for the completed wall component. Nevertheless, lower ratings can also be considered insulating depending upon applicable building codes. If necessary, "insulated" can be considered at least greater than 2 $m^2K^O$/Watt.

As used herein "lightweight" is related to the density of a building component or assembly (e.g. wall panel). In the context of the environment of the invention, materials or construction components/techniques are used or selected with the intention of achieving a building component that is less dense than would otherwise exist if the material or construction component/technique was not used or selected. Using density (kg/$m^2$) as the measure of a building component being lightweight, in the specific exemplary embodiment described above, a density of approximately 75 kg/$m^2$ was obtained for the completed wall component. Nevertheless, higher values can also be considered lightweight. If necessary, "lightweight" can be construed in relative terms where one building component or assembly is considered "lightweight" (i.e. "non-load bearing") due to the presence of other building components that are designed to be load bearing.

In this manner, there is provided a method which is simple and which leads to a high quality building with low building costs, but also leads to a building which can conform at least to fire safety regulations without costly additional measures. The building wall can conform to all basic requirements of building regulations, such as compressive strength, wind resistance etc, without costly additional measures.

Large wall elements can be used, such that a story high wall element completely fills the space between two adjacent upright building elements, such as columns or dividing walls. If the adjacent wall elements abut at the position of the upright building element, it is automatically covered. In the case of a column, the other, for example inner, side of the column may be covered by a separate panel to close off the space around the column. The wall surfaces on both sides of the building wall are typically flat, but for example at the position of the columns, the wall surface may be interrupted by protruding sections, or recessed sections. The columns may be prefabricated from wood, steel, or concrete or any combination thereof, but it is also possible to cast columns in situ by closing the space around the desired columns and to use the wall elements and panel as form work or shuttering to form the column from structural fill-material, such as concrete. In case of row houses or terraced houses in which the upright building elements are at least partially formed by dividing walls, the walls may be formed in situ or may consist of prefab walls which are erected before the wall elements are placed.

After the (outer) building walls of the building have been constructed, the walls may be processed, for example cut, to form openings and recesses in the walls to take up doors, windows, lines and pipes etc. Since the columns and/or dividing walls take up the majority of forces in the building, the openings in the wall elements may be created as desired without deteriorating the structural integrity of the building wall. As the wall elements are hardly loaded, they are not deformed and this obviates the need for frames around windows which are normally intended to protect the glass from forces in the wall. This reduces the building costs further. Frames are only necessary for supporting movable windows. Since there is great freedom in making openings in the walls and since these openings could be made only after constructing the walls of the building, the design of the building may be changed in a late stage of the building process. This makes the building concept very flexible.

As an alternative, the wall elements can be prefabricated, with all windows, doors, lines and/or other accessories mounted in the production facility. It is even conceivable to prefabricate complete (one story) facades or even the complete building before it is transported to the construction site.

Another aspect of the invention also includes a building. The building includes a skeleton for a building wall of the building. The skeleton includes at least upright building elements. At least one lightweight, heat insulating fire retarding wall element is disposed between each adjacent pair of said upright building elements. A covering layer is provided on each side of said wall elements and at least externally of the upright building elements to provide substantially closed wall surfaces, the covering layer having properties so as to provide at least fire-resistance to the complete wall.

In one embodiment, the covering layer includes a reinforcement layer, such as a woven mat, netting, mesh or the like, and a fibre reinforced layer.

This reinforcement layer provides added strength to the wall elements in order to provide resistance against external forces, such as wind or the like. A reinforcement layer on the inner side of the building may also provide added strength for mounting purposes inside the house, for example for hanging objects to the walls.

The wall element will generally be planar, but it may also be curved around one or more axes.

Floors in the building can be made by placing and interconnecting lightweight, heat insulating floor elements, supporting them if necessary, and pouring structural fill-material, such as concrete or the like, onto the floor elements to form the floor. For interconnecting the floor elements, thin steel profile sections can be used.

BRIEF DESCRIPTION OF THE DRAWINGS

The invention will hereafter be elucidated with reference to the drawings, showing embodiments of the invention by way of example.

FIGS. 1*a*, 1*b* and 1*c* are sectional plan views of columns that can be used in the building of FIG. 1.

DETAILED DESCRIPTION OF THE ILLUSTRATIVE EMBODIMENT

Figure 1:
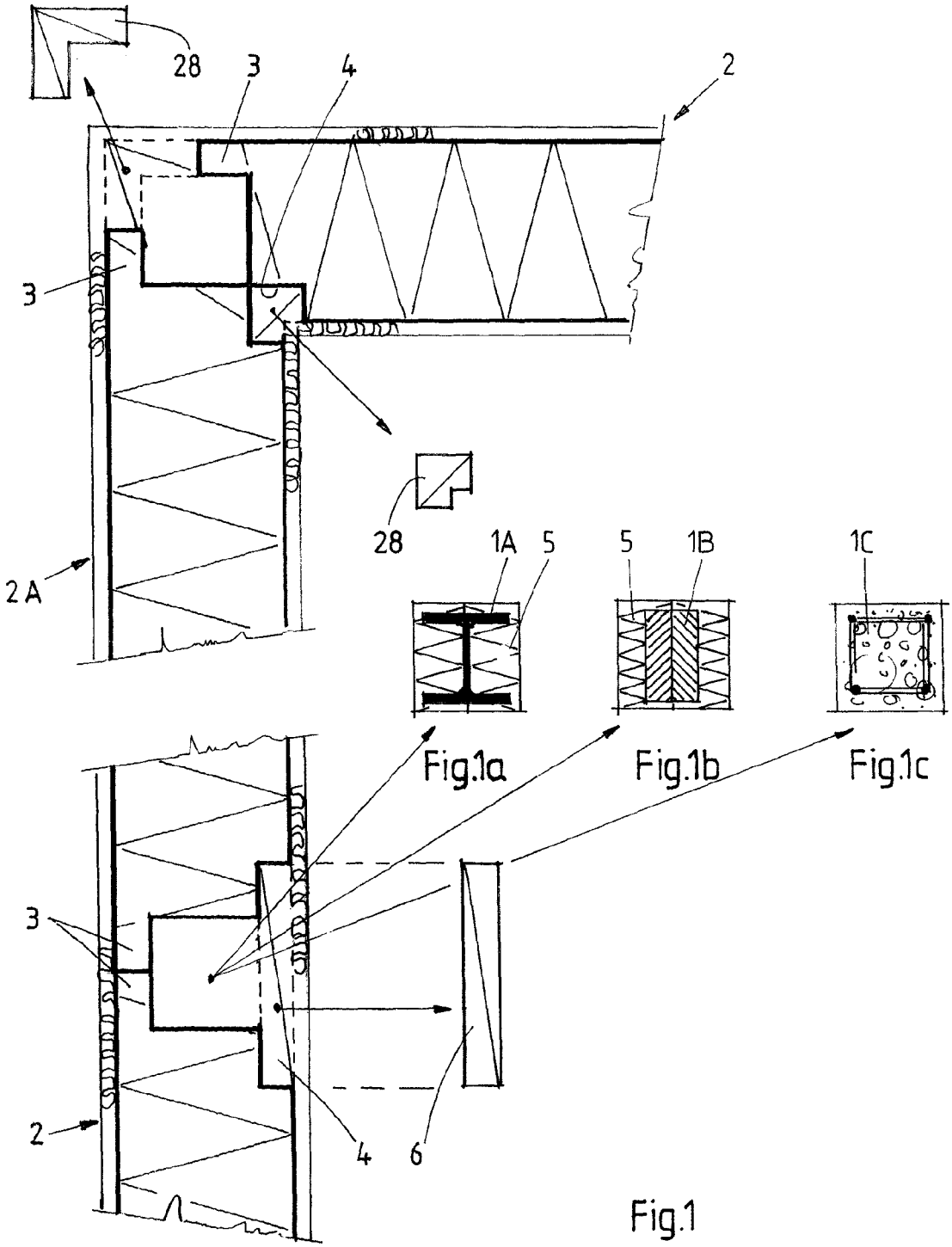
FIG. 1 is a sectional plan view of a part of a building wall in accordance with an embodiment of the present invention.
Figure 2:
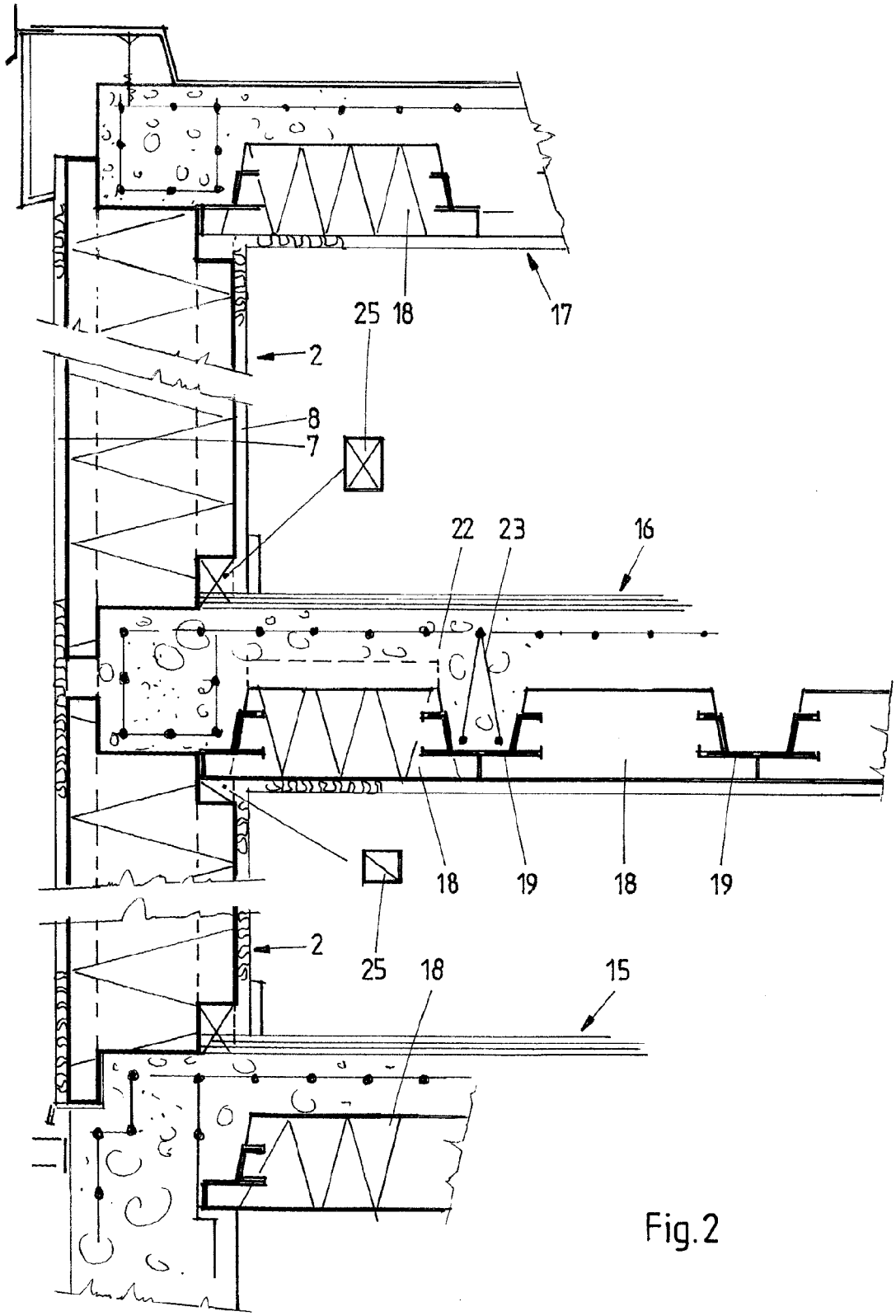
FIG. 2 is a sectional side view of a part of the building of FIG. 1.
Figure 3:
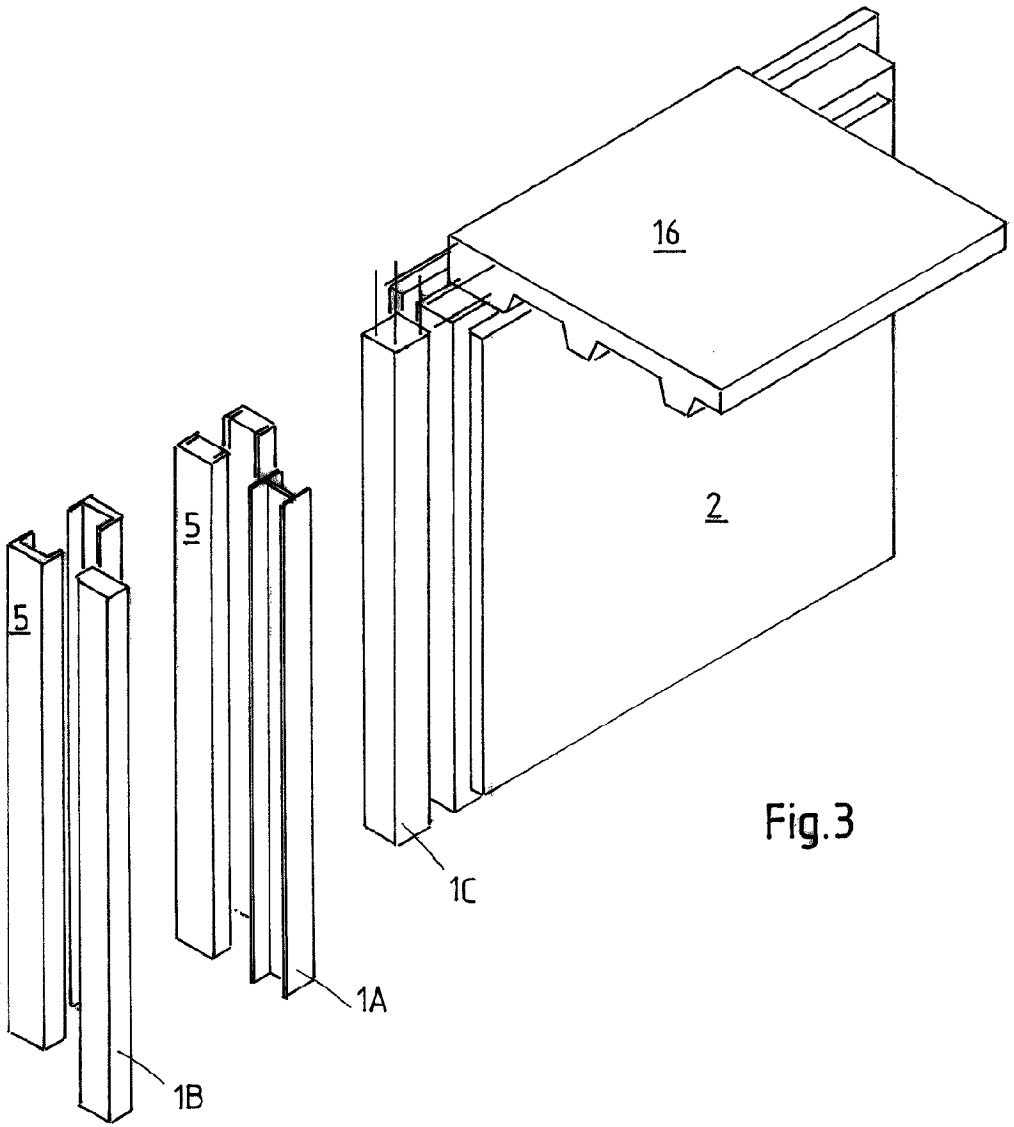
FIG. 3 is a perspective view of the parts making up the building wall of FIGS. 1 and 2.

The drawings, and in first instance FIGS. 1-3 show a part of a building wall in accordance with one aspect of the present invention. This building may be a house, but also buildings like offices or other utility buildings are conceivable. FIGS. 1 and 2 show that the building wall comprises a skeleton including upright building elements, in this case columns 1, and wall elements 2 filling the space between the columns 1. As is shown in FIGS. 1*a*, 1*b* and 1*c* the columns may consist of steel (FIG. 1*a*), wooden (FIG. 1*b*) or concrete (FIG. 1*c*) columns 1*a*, 1*b*, 1*c*. The concrete columns may be prefab columns or may be poured in situ. The wall elements 2 can have such dimensions, that they completely fill the space between the columns of one story, so that there is only one wall element 2 between each adjacent pair of columns 1. This obviates the need for complicated (mechanical) connections between wall elements.

Figure 5:
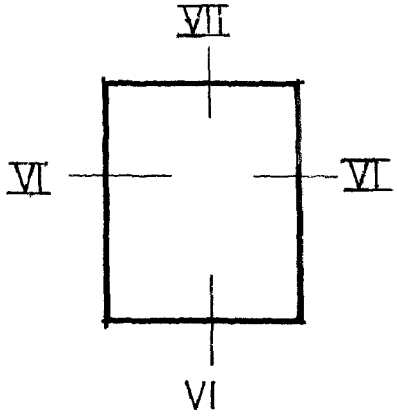
FIGS. 5, 6 and 7 are a front view (smaller scale) and sectional views along the lines VI-VI and VII-VII in FIG. 5 showing a wall element from the building of FIGS. 1 and 2.
Figure 7:
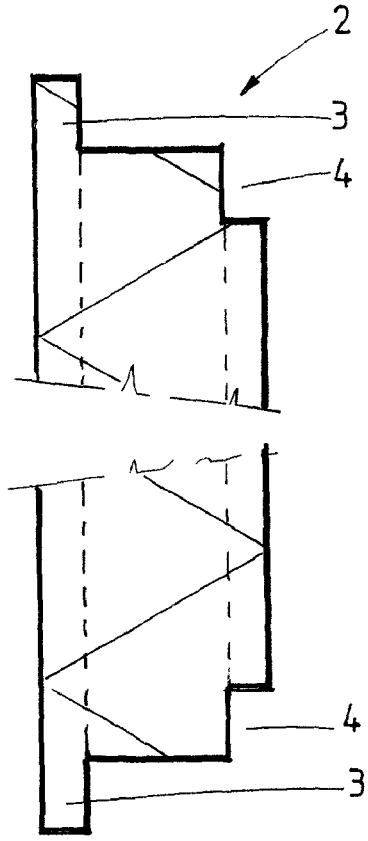
Figure 6:
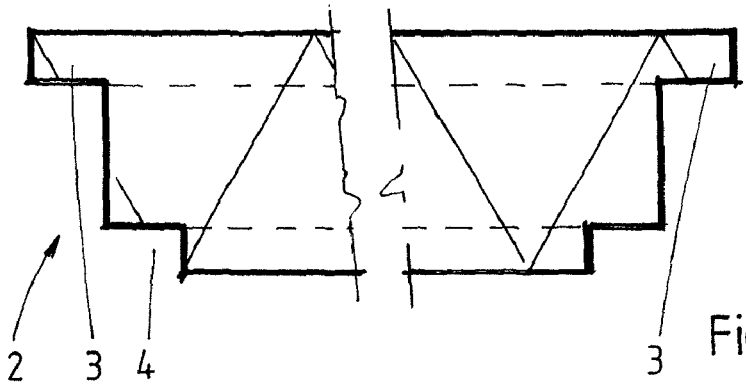

FIGS. 5-7 show the shape of one wall element 2. From FIG. 5 it is clear that the wall element 2 is rectangular. In this embodiment, the width of wall element 2 is 2.5 m, the height 3.0 m and the thickness 0.3 m, but such dimensions may of course be varied in accordance with the particular application and requirements. FIGS. 6 and 7 show that only the part of the wall element 2 that is intended to be placed on the outside of the building wall has the dimensions as indicated above. The remainder of the wall element 2 is smaller. Due to these reduced dimensions, there is formed a rim 3 on all four edges of the wall element 2. This rim 3 is flush with the outside surface of the wall element 2 and may have a thickness of circa 60 mm. The length of the rim may for example be circa 90 mm.

Adjacent to the opposite surface, intended to form the inner wall surface of the building wall, there is formed a recess 4 having substantially the same dimensions as the rim 3. This recess 4 is also formed on all four sides of the wall element 2. In this way the edges of the wall elements 2 have a stepped configuration of which middle step has a height for example corresponding to the thickness of the columns 1, while the depth of the first and last step for example corresponds to half the width of the projected columns 1

If two wall elements 2 are positioned next to each other, in an abutting relationship, there is formed a recess having three sides of 200 mm, which is intended for accommodating the columns, as is shown in FIG. 1. As the steel or wooden columns 1 will not exactly have these dimensions, they are provided with inserts 5 which are placed against the particular columns 1 in order to substantially fill the recess between the wall elements 2. A cover panel 6 may be positioned in the recesses 4 at the two adjacent edges of the wall elements 2 in order to close the recess between two wall elements, so that not only on the outside of the building wall, but also on the inside of the building wall a closed and continuous wall surface is formed. These closed and plane wall surfaces may be covered by covering layers 7 and 8 on the outside and inside of the building wall.

If columns are used which have larger dimensions, in particular a greater thickness, several situations may be created: first, wall elements having a greater thickness are used so that again completely plane wall surfaces can be obtained, furthermore, the column and/or a covering attached thereto may project on the inside and/or outside of the wall so that the wall surface has interruptions at the position of the columns.

Figure 8:
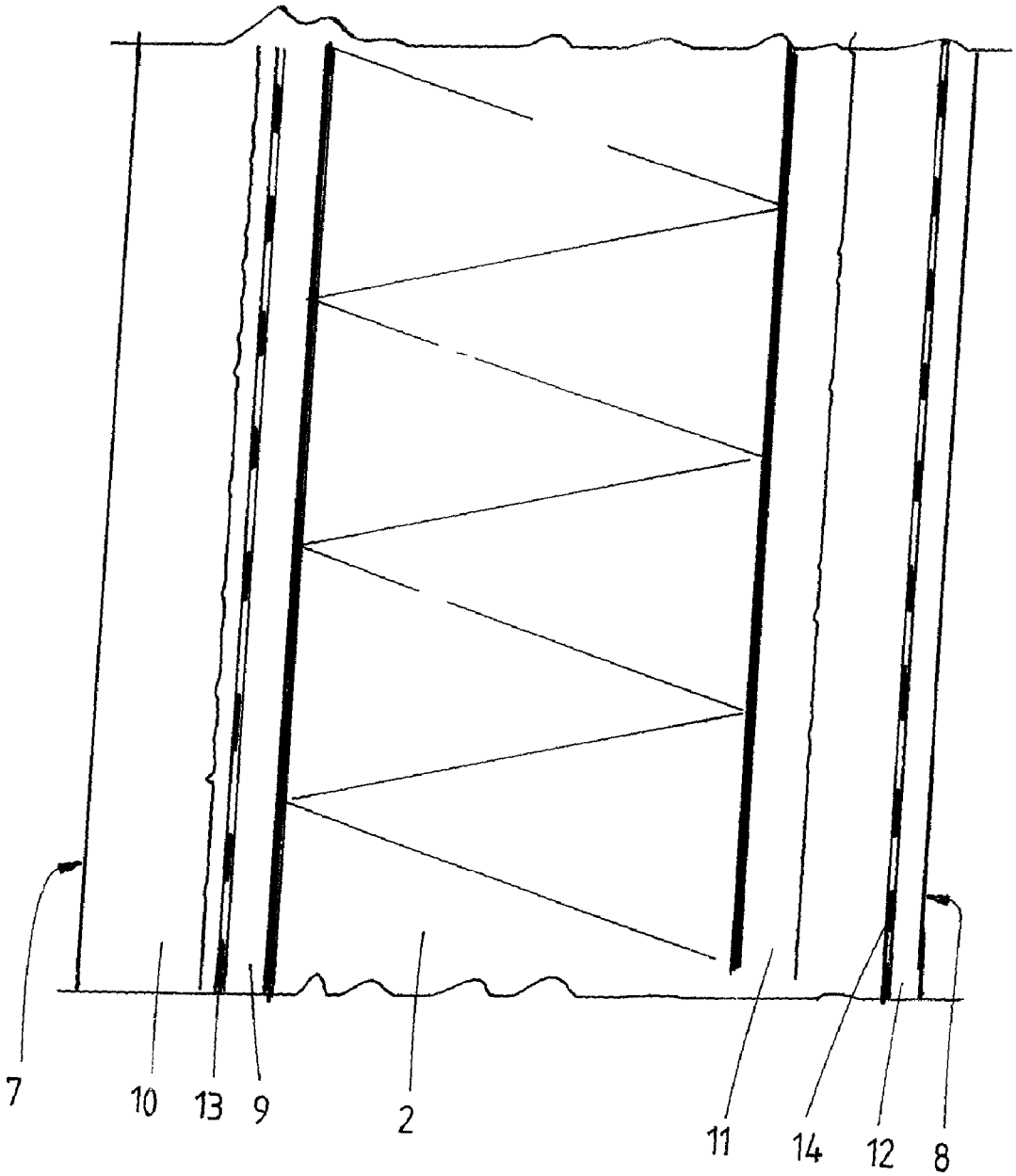
FIG. 8 is a larger scale sectional view of a portion of the wall element of FIGS. 5-7, illustrating the structure thereof.

FIG. 8 shows more a detailed section of the building wall at the position of a wall element 2. This wall element 2 forms the core of the building wall and is formed of a lightweight, heat insulating and in one embodiment fire retarding, non-shrinking and stabile material in order to give the proper quality to the building wall. This material may for example be modified and pressed cardboard (e.g. as is disclosed in EP-A-1 180 564, which is hereby incorporated by reference) or some expanded polymer, such as EPS (expanded polystyrene), for example that as offered by Unidek under the name Unidek EPS which is modified according to NEN 6065/6066 in order to obtain fire retarding properties.

The covering layer 7 on the outside of the building wall includes a first or base layer 9, preferably of modified resin mortar as is known in the art. This base layer 9 is an adhesive layer in order to properly attach a second or top layer 10, which may be a layer of mineral mortar for example, which has properties to resist weather conditions and other influences which may exist on the outside of a building. Such mineral mortar is also known in the art.

On the inside of the building wall, the covering layer 8 includes a first or base layer, preferably of modified resin mortar 11, and a second or top layer 12, for example formed by plaster mortar. The total thickness of the covering layers 7 and 8 may be in the range of 20-30 mm, preferably 22-25 mm. In this covering layers 7, 8 there is accommodated a reinforcement layer 13, 14, which may be a woven mat, netting, mesh or the like, for example a glass or carbon fibre reinforced mesh or non-woven material. At least one of the reinforcement layers 13, 14, in this case the reinforcement layer 14 on the inside, can be positioned near the surface of the covering layer 8 in order to be at the maximum distance from the neutral bending line of the wall element 2 in order to give maximum bending resistance, for example when a wind force is exerted on a building wall. Another advantage of this position of the reinforcement layer 14 is that it provides strength to this layer 8 so that the wall can be used to anchor fixing means, such as nails, screws, and the like in order to attach objects to the wall.

The expanded polystyrene material can be obtained in different qualities and in this embodiment, the wall element 2 may be formed of a standard quality, whereas the inserts 5 and cover panel 6 may be formed of higher compression material to provide additional heat insulation and strength around the columns 1 in order to obtain a substantially uniform heat-insulation quality through the entire wall.

Figure 9:
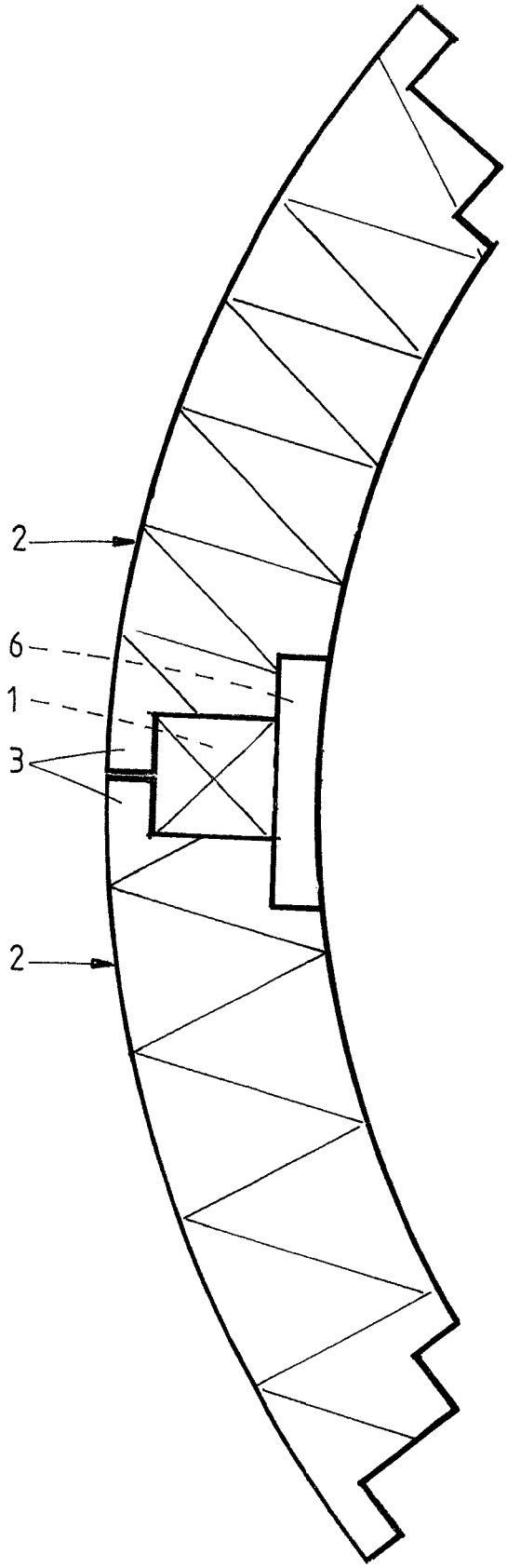
FIG. 9 is a sectional plan view of two elements according to another embodiment of the invention.
Figure 10:
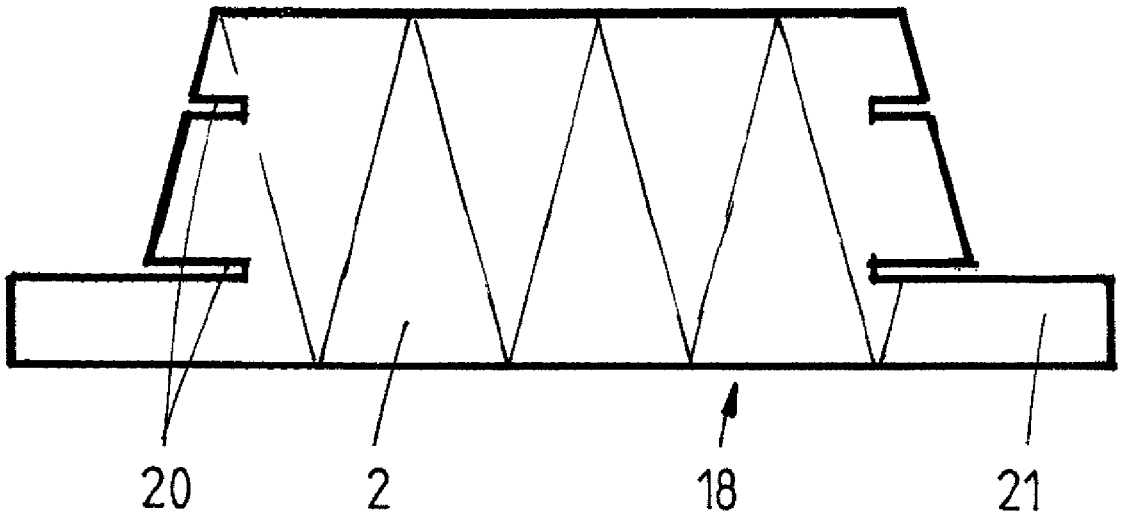
FIG. 10 is a cross-sectional view of a floor element from the building of FIG. 2.
Figure 11:
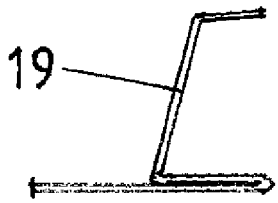
FIG. 11 is a cross-sectional view of a steel section profile used with the floor element of FIG. 10.

FIG. 9 shows a variation on the building wall of FIGS. 1 and 2, in which the wall elements 2 are curved around a vertical axis to form a circular wall.

Figure 4:
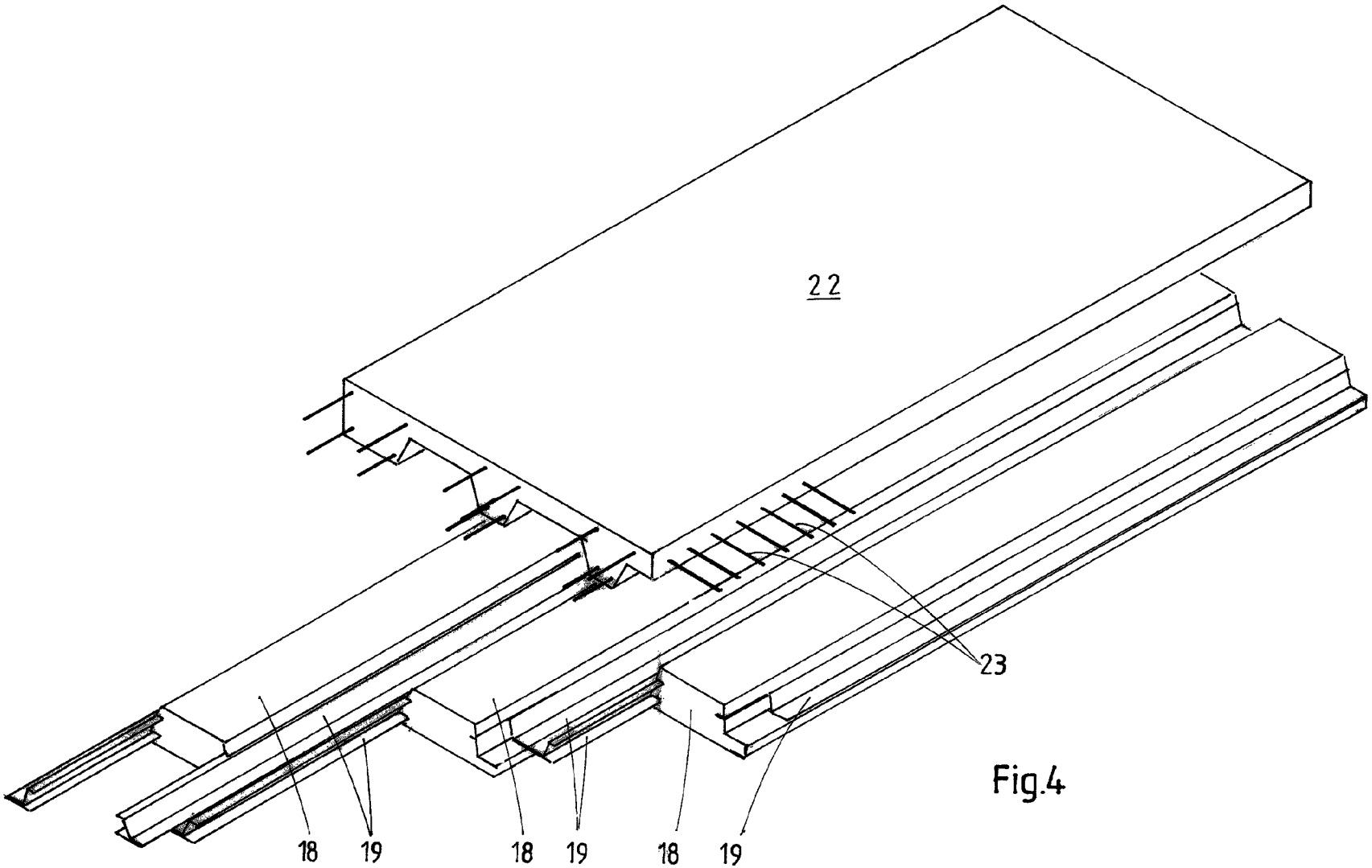
FIG. 4 is a perspective view of the parts making up the building floor.

FIG. 2 shows a sectional side view of the building of FIG. 1 illustrating not only the structure of the building wall, but also the floors of the building. The floor structure is also shown in FIG. 4.

In this case there is shown a ground floor 15, a story floor 16 and a roof floor 17. The structure of the floors 15-17 is similar, except for some differences in finishing. Each floor comprises floor elements 18 which are interconnected and are formed from similar material as the wall elements 2, i.e. from lightweight, insulating and fire retarding material. The floor elements 18 are interconnected by steel profiles 19 which may be formed from steel sheet, for example with a thickness of 1 mm. Recesses 20 are formed in the sides of the floor elements 18 in order to enable engagement of protruding parts of the steel profiles 19 to ensure proper attachment of the profiles to the floor elements. The floor elements 18 have lower rims 21 and these rims 21 of adjacent floor elements 18 are placed in abutting relationship to form a closed continuous lower surface of the floor. The upper part of the floor element 18 is smaller and has a trapezoid cross section. In order to form the floor, the floor elements 18 are connected and are supported by stays in order to resist the weight of structural fill-material, such as concrete 22, fibre reinforced resin or the like, which is poured onto the floor elements 18. Before the fill-material 22 is poured, steel reinforcements 23 are placed on the floor elements 18. If necessary, inserts 25 placed in recesses that might still visible after constructing the floors 15-17. A floor finishing 26, a ceiling finishing 27 and the covering layer 8 on the walls are provided, preferably in the final stage.

An embodiment of a method of constructing a building is as follows.

First of all, there is formed a foundation in and/or on the underground, if necessary at all. This foundation can be relatively light since the building will be much lighter than a traditional building. If a skeleton from steel or wood is used, the steel or wood columns 1 are placed on their foundation in the correct position. Inserts 5 are placed around the respective columns to create column dimensions to fit with the wall elements.

The wall elements 2 are then placed against the columns 1, such that the rims 3 are of the wall elements 2 are placed against the outside of the columns 1 and are positioned in abutting relationship with the next wall element 2. Glue may be used to fix the wall elements 2 to the columns 1 and to each other, but other fixing means are conceivable. A cover panel 6 is positioned in the recesses 4 of the wall elements 2 to cover the last side of the column 1. In the corners of the building inserts 28 are provided to fill any remaining gap. Then, the inserts 25 are mounted and the floor elements 18 are positioned on the lower inserts 25. Adjacent floor elements 18 are connected to each other by the profiles 19 and are supported on temporary supports. After placement of the reinforcements 23, the fill-material 22 is poured on the floor elements 18, on the profiles 19, on the upper side of the wall elements 2 and the columns positioned below.

If in this building method concrete columns are used that are cast in situ, the wall elements 2 are placed before the columns 1 are formed. Only a reinforcement for the concrete columns 1 is mounted within the recess formed by the adjacent wall elements 2. The cover panels 6 are mounted to form a formwork or shuttering for the concrete which is then poured in the closed recess so that a column of concrete or other structural fill-material, is formed between the wall elements 2.

From the foregoing it will be clear that the invention provides a building method and a building that is cost effective. The resulting building may be so light that it can be moved in its entirety, or stories may be built on the ground and lifted to its position afterwards. The energy- and maintenance cost are relatively low due to the high heat insulation and the low need for maintenance. The flexibility of the building is high due to the light construction which makes it easy to rebuild or extend parts of the building. In this respect, openings may be closed again by closing or replacing a wall element and new openings may be created after completion of the building. The building can be demounted again and the building materials can be reused. Therefore, the building method is also environmentally friendly. The wall elements may be used with a burglary alarm by integrating parts thereof in the wall elements, for example light conducting fibers, or electrically conducting wires.

As an alternative to the floors comprising floor elements and casted concrete, it is for example possible to construct a floor from steel sections, wooden beams, an insulation layer and a cement finishing layer.

Figure 12:
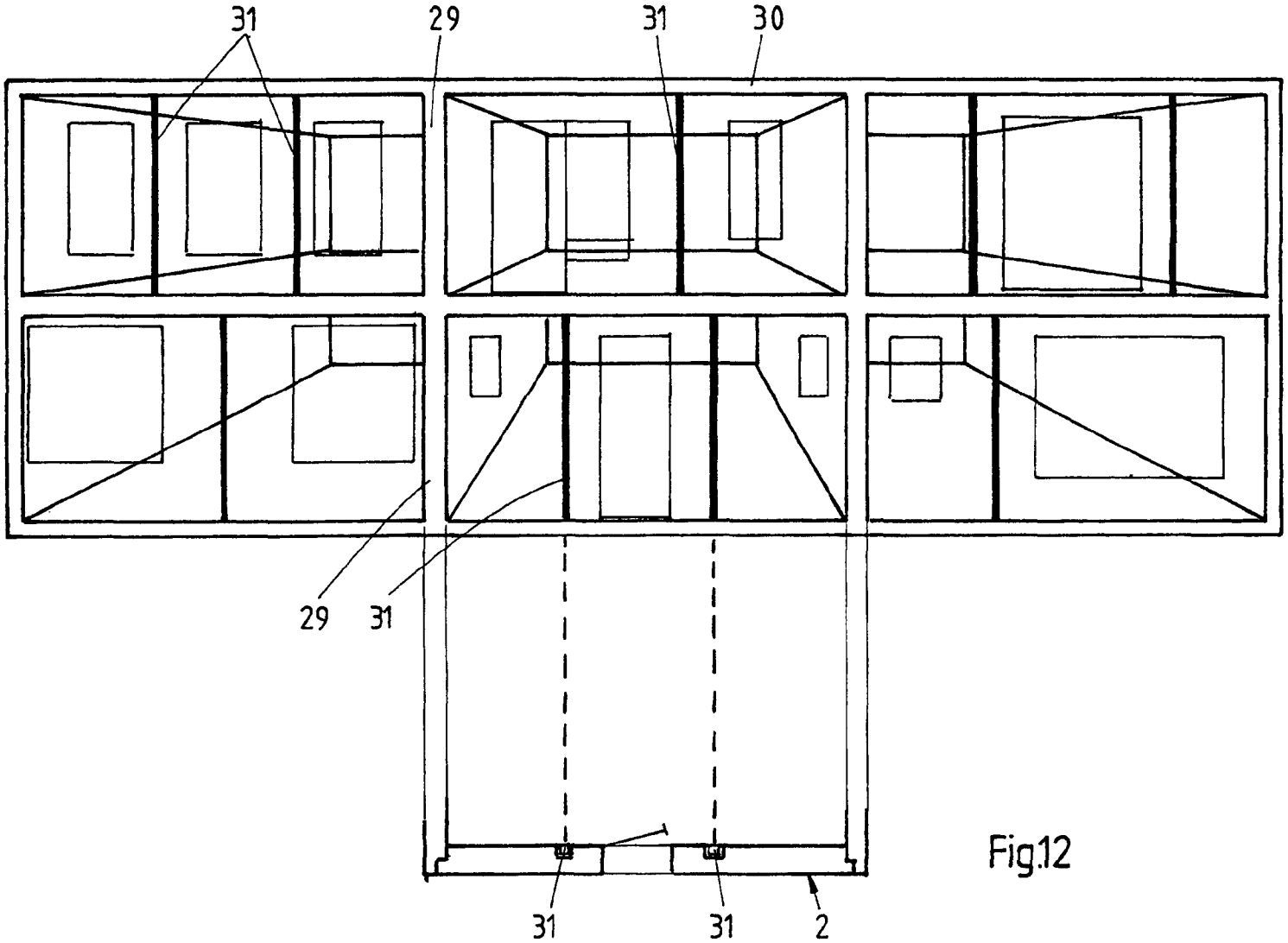
FIG. 12 is a front perspective view of another embodiment of a skeleton of the building according to the invention.

FIGS. 12-16 show a further embodiment of the building and method according to the invention. FIG. 12 shows a skeleton of a building, including separating or partitions walls 29 and floors 30. The dividing walls 29 function as a lightweight building element and separate in this case individual homes which are built in a row. In this embodiment, the wall element 2 forms a complete façade or outside wall between two adjacent dividing walls 29 and floors 30. Between adjacent dividing walls 29 there are provided one or more auxiliary columns 31, in this case in the form of steel sections, which are attached to the floor and ceiling 30. These auxiliary columns 31 may be integrated in the wall elements 2 or may be installed in the skeleton before the wall elements 2 is mounted to the skeleton.

Figure 13:
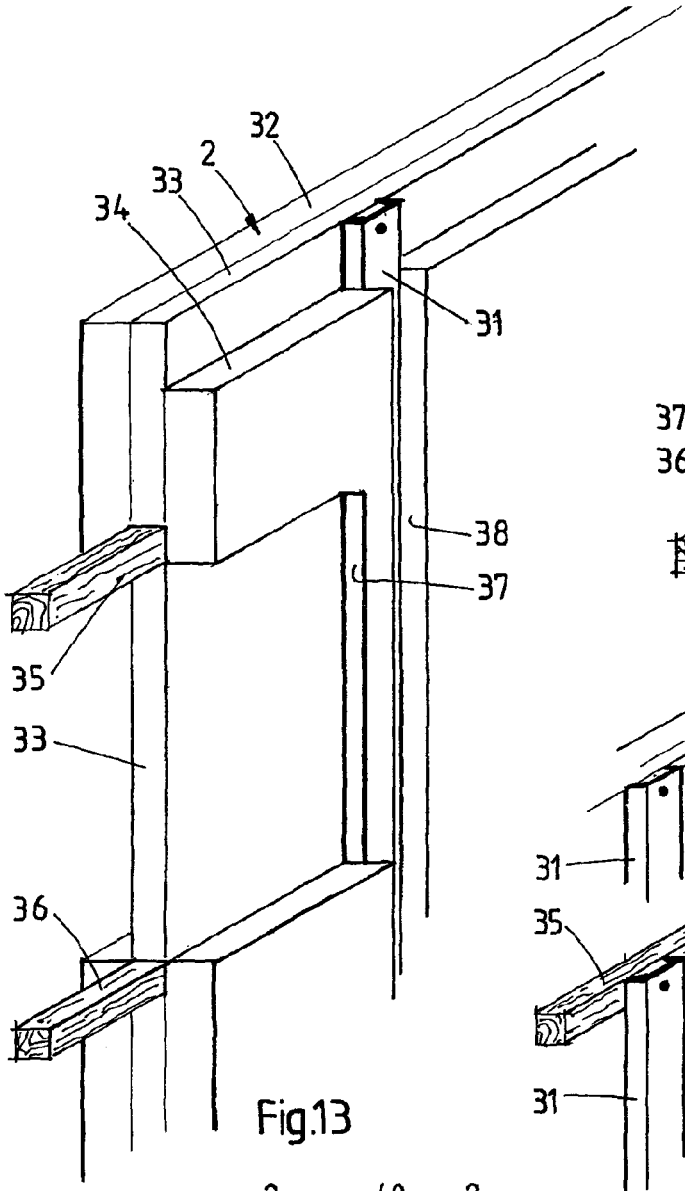
FIG. 13 is a perspective view of a wall element for use in the building skeleton of FIG. 12, on a larger scale.
Figure 14:
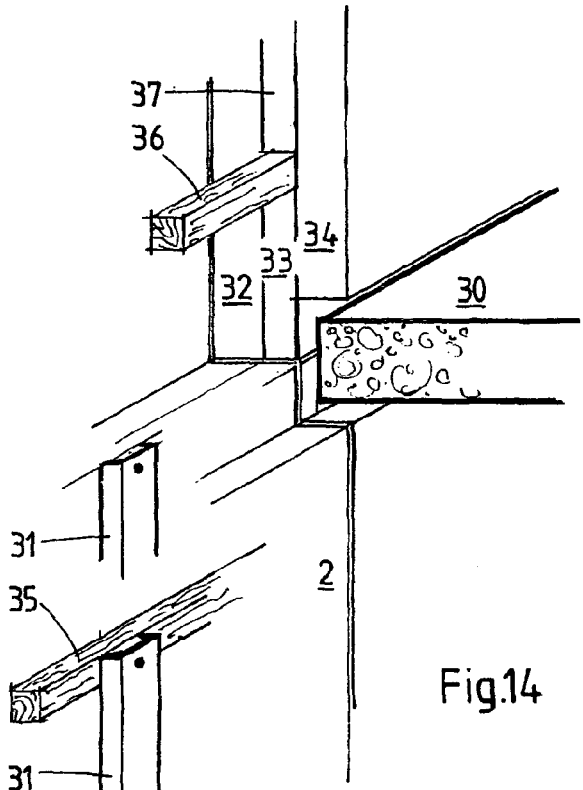
FIG. 14 are cut away details of the wall elements of FIG. 13 when built in the building of FIG. 12.
Figure 15:
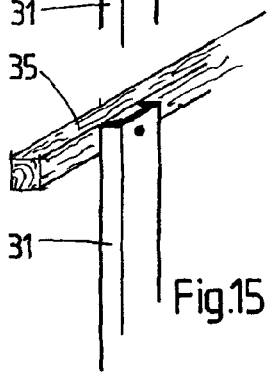
FIG. 15 shows in a perspective view the connection between a horizontal beam and a vertical auxiliary column as used in the building of FIG. 14.

FIGS. 13-16 show an embodiment of a wall element 2 which fits between two adjacent dividing walls 29. Therefore such wall element may be sized up to a length of 5 or 6 meters or more. In the embodiment shown, this wall element 2 has a laminate structure including layers 32, 33, 34 which are attached, for example glued together. Each layer 32, 33, 34 may be formed of different parts. The (relative) thickness of the various layers may be varied in accordance with the respective requirements. In one embodiment, the layers are each formed of different parts and the parts of the different layers being provided in an overlapping relationship so that they support each other. Integrated in the central layer 33 are in this case two horizontal beams 35, 36 made from wood or another suitable material such as plastic or the like. These horizontal beams are incorporated into the wall element 2 during the laminating process. These beams 35, 36 provide rigidity to the large wall element 2 and provide a means for attaching the wall element 2 to the auxiliary columns 31 and any window to the wall element 2. In FIG. 14 it is shown that an opening 37 is already left open in the layers 32 and 34 so that after placement of the wall element 2 only layer 33 should be processed in order to finish the wall opening 37 to be able to mount the window. The window or window frame can be mounted to both beams 35 and 36.

As mentioned before, the beams 35 and 36 can also be used to attach the wall element 2 to one or more auxiliary columns 31. In FIG. 13 it is shown that the inner wall layer 34 is recessed at the position where an auxiliary column 31 should be mounted to the wall element 2. In this recess 38 the beams 35 and 36 are visible and the auxiliary column 31 can be mounted to the beams 35, 36 by means of self tapping screws or the like which are inserted through a hole in the auxiliary column 31. Other types of attachments are conceivable.

If a door opening is to be made in the wall element 2, the lower horizontal beam 36 has to be interrupted and cut off at the door opening. The doorframe could be attached to the upper horizontal beam 35. Generally, an auxiliary column 31 will be positioned next to a door opening in order to provide additional support for the wall element at the position of the door. The door frame could also be attached to an adjacent auxiliary column 31. The covering layer 7 or 8 on the outside or inside of the building may be provided on the wall elements 2 before the windows and/or doors are positioned in the respective openings in the wall element 2. This is advantageous as the windows and doors can be mounted in the wall elements 2 as late as possible in order to avoid damage to these parts. This covering layer 7 or 8 will be provided within the opening 37 up to the position where the window frame will be positioned.

Figure 16:
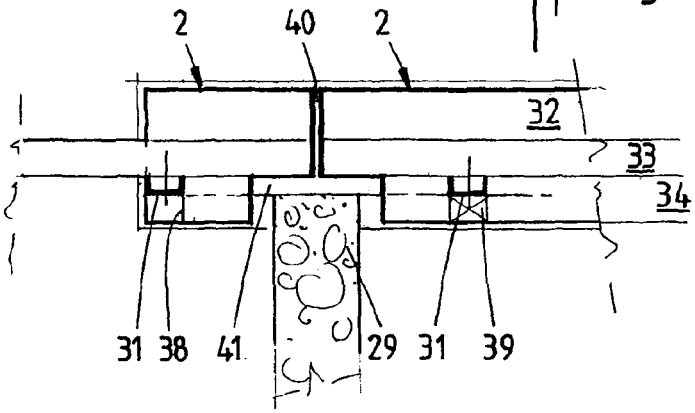
FIG. 16 is a horizontal sectional view of a building wall as used in the building of FIG. 12.

FIG. 16 shows that the recess 38 is filled with an insert 39 to cover the auxiliary column 31 and to fill the recess 38 in order to create a flush inner wall which can be covered by a continuous covering layer 8.

The joint 40 between adjacent wall elements 2 will be filled with a filler material, for example PUR glue which does not only fill the joint but also connects the adjacent wall elements 2 in a secure manner.

The large joint 41 between the wall elements 2 and the dividing wall 29 (or between the wall elements 2 and the floor 30 as shown in FIG. 13) is filled with a sound insulating material forming a barrier against the transmittal of sound around the dividing walls 29 or wall 30.

From the foregoing it is apparent that an aspect of the invention provides a wall element, in particular an outside wall element, which is durable, yet lightweight, fire resistant and easy to handle so that buildings may be constructed in a simple and quick manner. No extensive scaffolding is necessary, a light mobile device is sufficient to place wall elements above the ground floor.

The invention is not limited to the embodiments shown in the drawings and described above and may be varied in different manners within the scope of the invention. For example, the wall elements may be provided with (meandering) recesses to accommodate heating tubes of a wall and/or floor heating assembly.

What is claimed is:

1. A method of constructing a building, the method comprising:

providing a skeleton for the building, said skeleton including at least upright building elements, each of the upright building elements having a side facing in a direction toward an outside of the building;

placing at least one, lightweight, heat insulating and fire retarding wall element between each adjacent pair of said upright building elements which are positioned before the wall elements are placed, such that the wall elements completely fill the space between the upright building elements to form a complete wall, wherein each of the wall elements includes a front side facing toward the outside of the building and a back side that faces a direction that is opposite the front side, and wherein the front side of each of the wall elements is positioned further toward the outside than the side of each corresponding building element, and wherein at least some adjacent wall elements on each side of a corresponding upright building element abut each other on the front side facing in the direction toward the outside of the building;

covering said upright building elements at least on the outside to provide at least a substantially closed outer wall surface;

providing a cover panel in contact with first and second adjacent wall elements to form a substantially closed inner wall surface, wherein the cover panel is formed separately from the first and second adjacent wall elements and is placed after the first and second adjacent wall elements are placed and providing on each of the front side and the back side of the wall elements and in contact therewith, and at least on the outside of the upright building elements, a covering layer which has properties so as to provide at least fire-resistance to the complete wall, wherein the covering layer is placed after the wall elements are placed.

2. The method of claim 1, wherein the upright building elements are prefabricated columns which are positioned before the wall elements are placed, adjacent wall elements abutting to form a closed wall surface on the outside of the building.

3. The method of claim 2, and further comprising placing inserts adjacent to the columns to fill any gap between the columns and the wall elements.

4. The method of claim 1, and further comprising placing and interconnecting lightweight, heat insulating floor elements, and pouring structural fill-material onto the floor elements to form a floor.

5. The method of claim 1, and further comprising after the wall elements have been installed, processing the wall elements to form at least one of openings and recesses in the wall elements.

6. The method of claim 1, wherein the upright building elements are dividing walls between adjacent building spaces, the wall elements spanning the space between the dividing walls.

7. The method of claim 6, and further comprising attaching auxiliary columns to the building skeleton and integrating said auxiliary columns in the wall elements.

8. The method of claim 1, wherein portions of adjacent wall elements on each side of a corresponding upright building element abut at a location on a surface of the upright building element to form the substantially closed outer wall surface, and wherein the portions of the adjacent wall elements are positioned between the corresponding upright building element and the covering layer.

9. The method of claim 1, wherein at least some of the upright building element comprise an inner sue sort element and a first insert on a first side of the inner support element and a second insert on a second side of the inner support element, wherein the first side of the inner support element faces a direction that is opposite the second side of the inner support element.

10. The method of claim 1, wherein the cover panel is placed between and configured to engage corresponding recesses formed in the first and second adjacent wall elements.

11. The method of claim 10, wherein the covering layer is in contact with the cover panel and the first and second adjacent wall elements.

12. The method of claim 1, wherein the cover panel is formed of a material that has a higher compression and heat insulation capability than the wall elements.

13. A method of constructing a building, the method comprising:

providing a skeleton for the building, said skeleton including at least upright building elements, each of the upright building elements having a first side facing in a direction toward an outside of the building and a second side facing toward an inside of the building;

after at least three spaced apart adjacent upright building elements are provided thereby creating two pairs of successive upright building elements, inserting two wall elements formed of an expanded polymer, wherein a wall element is inserted between each pair of successive upright building elements, wherein each wall element includes a front side of the expanded polymer facing toward the outside of the building and a back side of the expanded polymer that faces a direction that is opposite the front side, and wherein prior to inserting each of the wall elements between the pairs of successive upright building elements, each wall element has a thickness of the expanded polymer from the front side to the back side greater than the thickness of the corresponding adjacent upright building elements as measured from the first side to the second side of each corresponding adjacent upright building element, and wherein when the two wall elements are inserted between the pairs of successive upright building elements edges of the two wall elements abut each other on the front side of the upright building element disposed between the two wall elements; and providing a covering layer on and in contact with the front side of the two wall elements, wherein the covering layer includes a reinforcement layer and has properties so as to provide at least fire-resistance, wherein providing the covering layer comprises:

placing a first continuous layer of material on the front side of the two wall elements that also covers the abutting edges of the two wall elements; and after the first layer is placed, placing a second continuous layer of material in contact with and over the first layer.

14. The method of claim 13, wherein the first continuous layer comprises modified resin mortar that is utilized to adhere the second continuous layer to the wall elements.

15. The method of claim 14, wherein the second continuous layer comprises plaster mortar.

16. The method of claim 13, wherein the first continuous layer has a front side facing toward the outside of the building and a back side that faces a direction that is opposite the front side, and wherein the reinforcement layer is positioned in the first continuous layer between the front and back sides of the first continuous layer.

17. The method of claim 13, wherein the second continuous layer has a front side facing toward the outside of the building and a back side that faces a direction that is opposite the front side, and wherein the reinforcement layer is positioned in the second continuous layer between the front and back sides of the second continuous layer.

18. The method of claim 13, wherein the front side of each wall element extends beyond the first side of each of the corresponding adjacent upright building elements.

19. The method of claim 13, wherein the first continuous layer covers at least some of the first side of each of the at least three upright building elements in a continuous manner.

20. A method of constructing a building, the method comprising:

providing a skeleton for the building, said skeleton including at least upright building elements, each of the upright building elements having a first side and a second side facing in a direction opposite to the first side;

placing at least one, lightweight, heat insulating and fire retarding wall element between each adjacent pair of said upright building elements which are positioned before the wall elements are placed, such that the wall elements completely fill the space between the upright building elements to form a complete wall, wherein each of the wall elements includes a first side and second side facing in a direction opposite to the first side, and wherein the first side of each of the wall elements is positioned beyond the first side of the upright building elements in a direction in which the first side of the upright building element faces;

covering said upright building elements at least on the first side to provide at least a substantially closed outer wall surface;

providing a cover panel in contact with first and second adjacent wall elements to form a substantially closed wall surface with the second side of the first and second adjacent wall elements, wherein the cover panel is formed separately from the first and second adjacent wall elements and is placed after the first and second adjacent wall elements are placed and providing on each of the first side and the second side of the wall elements and in contact therewith, a covering layer which has properties so as to provide at least fire-resistance to the complete wall, wherein the covering layer is placed after the wall elements are placed.

21. The method of claim 20, wherein the upright building elements are prefabricated columns which are positioned before the wall elements are placed, adjacent wall elements abutting to form a closed wall surface on the first side.

22. The method of claim 21, and further comprising placing inserts adjacent to the columns to fill any gap between the columns and the wall elements.

23. The method of claim 20, and further comprising placing and interconnecting lightweight, heat insulating floor elements, and pouring structural fill-material onto the floor elements to form a floor.

24. The method of claim 20, and further comprising after the wall elements have been installed, processing the wall elements to form at least one of openings and recesses in the wall elements.

25. The method of claim 20, wherein the upright building elements are dividing walls between adjacent building spaces, the wall elements spanning the space between the dividing walls.

26. The method of claim 25, and further comprising attaching auxiliary columns to the building skeleton and integrating said auxiliary columns in the wall elements.

27. The method of claim 20, wherein portions of adjacent wall elements on each side of a corresponding upright building element abut at a location on a surface of the upright building element to form the substantially closed outer wall surface, and wherein the portions of the adjacent wall elements are positioned between the corresponding upright building element and the covering layer.

28. The method of claim 20, wherein at least some of the upright building elements comprise an inner support element and a first insert on a first side of the inner support element and a second insert on a second side of the inner support element, wherein the first side of the inner support element faces a direction that is opposite the second side of the inner support element.

29. The method of claim 28, wherein the covering layer is in contact with the cover panel and the first and second adjacent wall elements.

30. The method of claim 20, wherein the cover panel is placed between and configured to engage corresponding recesses formed in the first and second adjacent wall elements.

31. The method of claim 20, wherein the cover panel is formed of a material that has a higher compression and heat insulation capability than the wall elements.

* * * * *

UNITED STATES PATENT AND TRADEMARK OFFICE

CERTIFICATE OF CORRECTION

PATENT NO. : 7,946,092 B2
APPLICATION NO. : 12/605928
DATED : May 24, 2011
INVENTOR(S) : Albertus Theodorus Gerardus Veerman et al.

It is certified that error appears in the above-identified patent and that said Letters Patent is hereby corrected as shown below:

In the Claims

Column 9, Claim 9:

In line 45, delete "sue sort" and insert -- support --

Signed and Sealed this
Fifth Day of August, 2014

Michelle K. Lee

Michelle K. Lee
*Deputy Director of the United States Patent and Trademark Office*